United States Patent [19]

Kneusel et al.

[11] 4,024,980

[45] May 24, 1977

[54] EASY OPENING CAN END HAVING A CLOSURE PLUG

[75] Inventors: Raymond H. P. Kneusel, Flourtown, Pa.; Vinson S. Potts, Cherry Hill, N.J.

[73] Assignee: Crown Cork & Seal Company, Inc., Philadelphia, Pa.

[22] Filed: May 7, 1976

[21] Appl. No.: 684,403

Related U.S. Application Data

[63] Continuation of Ser. No. 522,097, Nov. 8, 1974, abandoned.

[52] U.S. Cl. ..... 220/260; 220/281; 220/307; 220/359; 220/367; 222/485

[51] Int. Cl.[2] ..... B65D 41/02

[58] Field of Search ..... 220/260, 281, 366, 367, 220/240, 359, 254, 307; 222/485

[56] References Cited

UNITED STATES PATENTS

| | | | |
|---|---|---|---|
| 2,254,453 | 9/1941 | Scharmett | 220/281 |
| 2,842,295 | 7/1958 | Bajada | 220/485 |
| 3,236,409 | 2/1966 | Cross | 220/260 |
| 3,662,914 | 5/1972 | Slade | 220/367 |
| 3,759,206 | 9/1973 | Dalli | 220/281 |
| 3,794,206 | 2/1974 | De Line | 220/281 |
| 3,800,971 | 4/1974 | La Vista | 220/281 |
| 3,843,011 | 10/1974 | Perry | 220/260 |

*Primary Examiner*—George T. Hall
*Attorney, Agent, or Firm*—Woodcock, Washburn, Kurtz & Mackiewicz

[57] ABSTRACT

A can end of the easy-opening type includes an end panel having a dispensing opening and a vent hole. A push-in dispensing opening plug extends into the dispensing opening and sealingly engages the end panel. A vent hole plug extends into the vent hole and sealingly engages the end panel. In one embodiment, the vent hole plug is smaller than the dispensing opening plug and includes a radially outwardly extending portion for retaining the vent hole plug within the vent hole after venting.

45 Claims, 17 Drawing Figures

14
10
20
22
12
16
18
18

12
32
28
34
38
26
30
24
36
22
38
26
20
38
26

12
32
30
34
24
38
26
36
22
38
26
20
38
26
30

EASY OPENING CAN END HAVING A CLOSURE PLUG

This is a continuation, of application Ser. No. 522,097, filed Nov., 8, 1974, now abandoned.

BACKGROUND OF THE INVENTION

This invention relates to easy opening containers or cans which may be opened by hand without benefit of an opening tool.

The most commercially successful easy opening cans utilize a tab which is formed by scoring a can end panel and removed by grasping a ring attached thereto and ripping of the tab from the end panel along the score lines. Aluminum is usually utilized for ring-tab ends of this type because of its soft and malleable qualities which allow the use of substantial residual scoring depths while still permitting removal of the tabs by hand.

However, aluminum can ends are objectionable from a number of standpoints. Aluminum is expensive and of relatively low strength as compared with a metal such as steel so that large quantities of aluminum must be utilized to provide can ends of sufficient gauge to withstand internal pressures generated within the cans. In addition, aluminum is expensive relative to steel, and aluminum can ends are also undesirable as compared with steel from an ecological standpoint since aluminum is not readily degradable. Furthermore, aluminum can ends are often utilized with steel can bodies and this combination is undesirable since an electrochemical reaction may be set up within the can due to its dual metallic nature, thereby creating the risk that the contents within the container may become contaminated.

In view of the foregoing difficulties with the easy opening can ends made from aluminum, rather substantial efforts have been made to develop an easy opening can end design which would be suitable for use with other metal ends such as steel ends. A number of proposed prior art designs have involved the use of metal or plastic plugs which are inserted into dispensing openings and vent holes of can ends which may comprise a metal other than aluminum such as steel.

U.S. Pat. No. 3,800,971 - LaVista discloses an easy opening can end having a push-in plug closing a dispensing opening. The edges of the metal push-in plug as well as the edges of the can end surrounding the dispensing opening are exposed to the contents of the container and there is no vent hole or plug for closing the vent hole. U.S. Pat. No. 3,662,914 - Slade discloses an easy opening can end with a unitary pull-out for the dispensing opening as well as the vent hole where the edge of the can end at the dispensing opening and the vent hole are covered by the dispensing opening and the vent hole plug portions. U.S. Pat. No. 1,190,043 - Thompson et al discloses a push-in plug which contacts the edge of an end panel surrounding the opening. However, there is no sealing engagement between the end panel and plug which would isolate the edge surrounding the opening so as to avoid exposing the contents of the container to this edge.

U.S. Pat. No. 3,756,448 - Moller et al discloses a plastic unitary pull-out plug member similar to that disclosed in the Slade patent. The edges of the opening in the Moller et al can end are covered by a rim comprising a plastic material. A similar plastic unitary plug for closing a dispensing opening spaced from a vent hole opening is disclosed in U.S. Pat. 3,744,662 - Zundel.

U.S. Pat. No. 3,759,206 - Dalli et al discloses can ends having integrally connected, push-in tab members. The interior of the end at the edge of the opening is covered with a sealing material to isolate the edge of the opening as well as the edge of the tabs and the contents within the can. U.S. Pat. No. 2,842,295 - Bajada discloses push-in plugs which are press fitted into openings which snugly and sealingly engage a vertically extending flange leading to the edge of the opening.

SUMMARY OF THE INVENTION

It is an overall object of this invention to provide an improved easy opening can end which may comprise any of a number of metals including steel.

It is a more specific object of this invention to provide an easy opening can end as described in the foregoing object which may be opened with considerable ease.

It is a further specific object of this invention to provide an easy opening can end consistent with the aforesaid objectives which does not present a risk of contamination by the raw edge of the panel which surrounds the opening therein.

In accordance with these objects, a can end of the easy-opening type comprises an end panel having an opening extending from the upper side to the under side thereof and a push-in plug extending into the opening and sealingly engaging the end panel so as to close the opening. The plug includes a first portion extending radially outwardly from the edge of the panel at the opening on the under side of the panel.

In accordance with one important aspect of the invention, the area of sealing engagement between the plug and the end panel is above the first portion of the plug and radially outwardly from the edge of the panel such that the effectiveness of the seal is increased in response to a pressure differential between the upper side and the under side of the plug thereby enhancing the isolation of the edge of the panel from the contents of the can as pressure within the can increases.

In accordance with another important aspect of the invention, the plug includes a second portion extending radially outwardly from the edge of the panel at the opening on the upper side of the panel. The second portion cooperates with the panel so as to retain the plug in the opening before application to a can while also providing predictably uniform opening resistance when the plug is pushed into the can.

In one preferred embodiment of the invention, an easy-opening can comprises a can body and an end panel attached to the can body having a dispensing opening and a venting hole spaced from the dispensing opening where the vent hole is smaller than the dispensing opening. A pushin dispensing opening plug of the previously described type extends into the dispensing opening and sealingly engages the end panel so as to close the dispensing opening. A pushin vent hole plug also of the previously described type extends into the vent hole and sealingly engages the end panel so as to close the vent hole. In addition, the vent hole plug includes means for retaining the vent hole plug within the vent hole when the vent hole plug has been pushed into a second venting position so as to prevent the passage of the vent hole plug through the dispensing opening during the consumption or pouring of the can contents through the dispensing opening.

The vent hole plugs as well as the dispensing opening plugs may comprise sheet metal or a plastic material. Where sheet metal is utilized, a relatively soft sealing material is applied in the area of sealing engagement on the under side of the end panel and the sheet metal plug contacts the sealing material so as to preclude contamination of the contents of the can by the edge of the end panel at the vent hole or dispensing opening as well as the edge of the vent hole plug or dispensing opening plug. Where plastic is utilized in the plug, the interior portion of the plug is capable of forming a seal itself in the area of sealing engagement without benefit of a sealing material other than the plug itself.

BRIEF DESCRIPTION OF THE DRAWINGS

FIGS. 4(*a-i*) are sectional views of alternative dispensing plugs and end panel profiles;

DETAILED DESCRIPTION OF PREFERRED EMBODIMENTS

Figures 1, 2, 3:
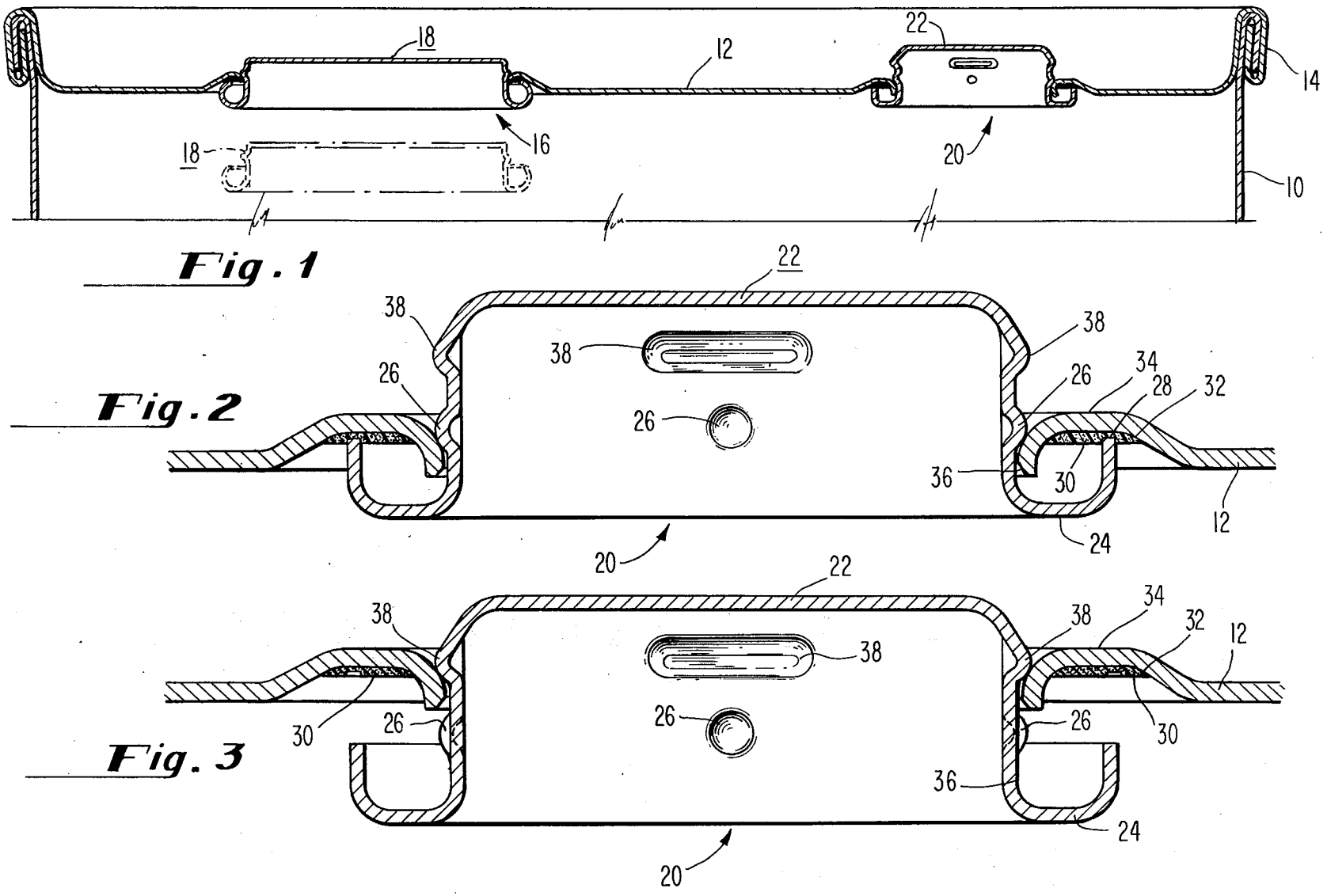
FIG. 1 is a sectional view of an easy opening can end representing one embodiment of the invention.
FIGS. 2 and 3 are sequential sectional views of the vent hole plug and end panel in the embodiment of FIG. 1 shown in the closed and venting positions respectively.

A can of the easy-opening type is shown in FIG. 1 as comprising a can body 10 and an end panel 12 attached to the body 10 by a double seam 14. The end panel includes a dispensing opening 16 closed by a sheet metal push-in dispensing opening plug 18 constructed in accordance with this invention. The end panel 12 also includes a vent hole 20 closed by a sheet metal push-in vent hole plug 22 constructed in accordance with this invention.

In order to facilitate venting through the vent hole 20, the vent hole 20 as well as the vent hole plug 22 are substantially smaller than the dispensing opening 16 and the dispensing opening plug 18. As a result, the vent hole plug 22 may be pushed from a first closed position as shown in full in FIG. 1 through a second venting position shown in FIG. 3 by applying lesser pressure to the exterior of the vent hole plug 22 than would be required to push the dispensing opening plug 18 into the can. It will, of course, be appreciated that the contents of the can will, in many instances, be pressurized thereby offering a considerable resistance. Use of the smaller vent hole 20 and the smaller vent hole plug 22 is therefore important in facilitating the opening of the can so as to make it a truly "easy" opening can.

Note however, that the vent hole plug 22 is not allowed to fall freely into the can as is the dispensing opening plug 18. Rather, the vent hold plug 22 is retained within the end panel 12 since the small size of the vent hole plug 22, which is necessary to provide for easy venting of the can, would permit vent hole plug 22 to pass through the dispensing opening 16 if it were not retained within the vent hole 20. This, of course, would create a very dangerous condition since the vent hole plug would be poured or dispensed with the contents of the can.

Reference will now be made to FIGS. 2 and 3 wherein the vent hole plug and its operation will be described in detail. As shown in FIG. 2, the vent hole plug 22 extends through the vent hole 20 when in the closed or sealing position. The plug 22 is retained in the closed position by first means comprising a first radially outwardly extending interior portion or annular flange 24 on the under side of the end panel 12.

In accordance with one important aspect of the invention, a relatively soft sealing compound or material 30 is retained within an annular groove 32 formed by a raised portion 34 of the end panel 12 around the vent hole 20. The flange 24 sealingly engages the under side of the end panel by embedding the edge 28 of the plug 22 in the sealing material 30. Note that the area of sealing engagement is located radially outwardly from the edge 36 of the panel at the vent hole 20 and above the flange 24. Thus, as pressure increases on the interior of the can, i.e., pressure differential on the upper side of the plug 22 increases, the seal in the area of sealing engagement becomes more effective thereby enhancing the isolation of the edge 36 of the panel from the contents of the can as pressure within the can increases.

In accordance with another important aspect of the invention, the first means for retaining plug 22 within the vent hole 20 comprises a second portion in the form of one or more dimples 26 which extend radially outwardly from the edge of the panel at the vent hole 20. The dimples 26 cooperate with the panel so as to retain the plug 22 in the vent hole 20 prior to application of the can end to the can. The use of a radially outwardly extending projection such as the dimples 26 is of particular significance since it provides retention of the plug 22 within the vent hole 20 while also providing predictably uniform opening resistance to the plug once the can end 14 is mounted on the can.

The dimples 26 may also be of assistance in maintaining a seal between the plug 22. In other words, the dimples 26 are appropriately spaced with respect to the flange 24 to assure that proper sealing engagement is made between flange 24 and the panel 12 at the edge 28 which is embedded within the sealing material 30 even in the absence of internal pressure within the can.

As clearly shown in FIG. 2, the portion of the flange 24 which is embedded in the sealing material 30 creates an area of sealing engagement above the edge 28 of the flange 24 and below the under side of the end panel 12 at the groove 32. This seal prevents any communication between the exterior of the can and the interior of the can through the vent hole 20 while also preventing any contamination of the contents within the can by the raw edge 28 of the sheet metal plug 22.

In order to avoid cutting the fingers of a person opening the vent hole, the panel 12 adjacent the edge 36 is curled downwardly so as to be substantially vertical adjacent the edge 36. In addition, the edge 36 is coined to eliminate any sharp, radially inwardly opening projection at the edge 36.

The plug 22 includes a second means comprising a radially outwardly extending retaining portion in the form of a plurality of dimples 38 which are axially spaced from the dimples 26. As shown in FIG. 3, the curl adjacent the edge 36 of the panel 12 extends inwardly between the dimples 38 and the dimples 26 so as to prevent the plug 22 from falling into the can when the plug 22 is in the venting position. In order to prevent forcing the plug 22 all the way into the can unintentionally, the dimples 38 extend radially outwardly beyond the dimples 26 so that a force sufficient to push the dimples 26 past the edge 36 is insufficient to push the dimples 38 past the edge 36. In addition, the dimples 38 have a longer circumferential length than the dimples 26 to afford greater resistance when the plug is pushed in.

Figure 4:
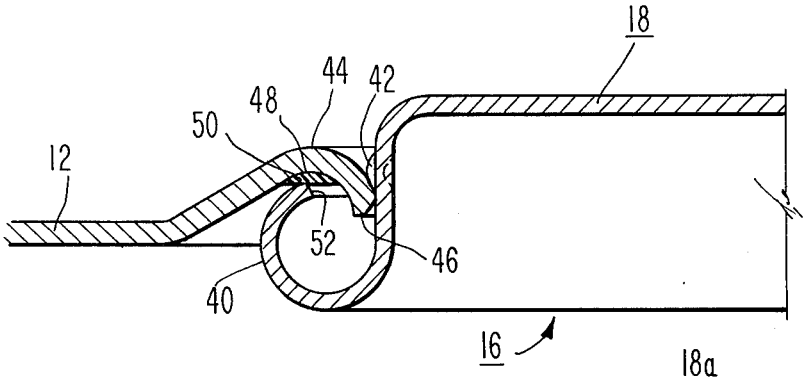
FIG. 4 is a sectional view of the dispensing opening plug of the embodiment shown in FIG. 1 in the closed position.

Reference will now be made to FIG. 4 for a more detailed understanding of the cooperation between the dispensing opening 16 and the dispensing opening plug 18. As shown in FIG. 4, the plug 16 is retained in the closed position by first means comprising a radially outwardly extending portion or annular curl 40 and an exterior radially outwardly extending portion comprising dimples 42. The edge 46 of the panel at the opening then extends between the dimples 42 and the curl 40 in simultaneous engagement therewith so as to close the dispensing opening 16.

In order to assure sealing engagement between the dispensing opening plug 18 and the panel 12, the end panel is also provided with a raised portion 44 adjacent the edge 46 of the panel 12 so as to form a recess 48 which receives a sealing compound or material 50. The edge 52 of the curl 40 on the sheet metal plug 18 is then partially embedded within the sealing material 50 with no portion of the edge 52 exposed to the interior of the can. The area of sealing engagement between the curl 40 and the panel 12, which is located radially outwardly beyond the edge 46 and above the edge 52 of the plug 18, precludes any communication between the contents of the can and the edge 46 as well as the edge 52. The pressure of the contents within the can assure that the edge 52 is deeply embedded in the material 50 thereby enhancing the isolation of the edge 46 and the edge 52 with increased pressure.

Note that the panel 12 adjacent the edge 46 is also curled downwardly to avoid the risk of cutting the fingers of an individual opening the can. In addition, the edge 46 is coined to eliminate any exposed sharp edges.

Figure 4A:
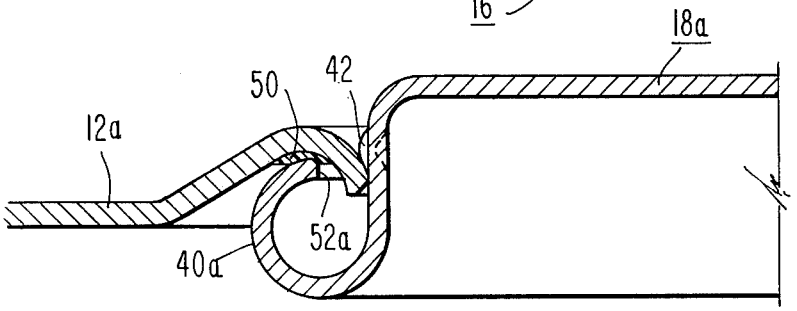
Figure 4B:
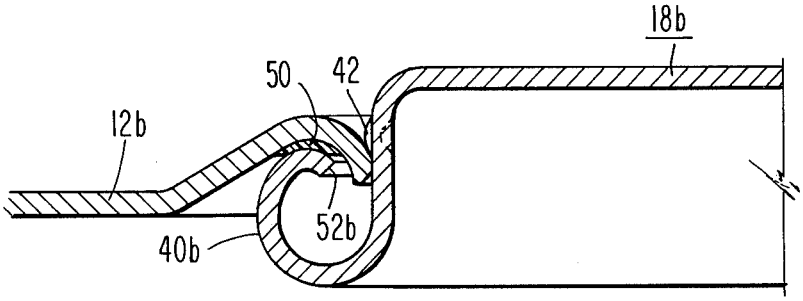

FIGS. 4(*a-i*) show a number of alternative configurations which may be utilized for the dispensing plug 18. In FIG. 4*a*, the curl 40*a* of the plug 18*a* which may be made in one forming operation extends radially inwardly at the edge 52 a greater distance than in the plug 18 so as to have a greater portion embedded in the sealing material 50. In FIG. 4*b*, the curl 40*b* of the plug 18*b* has a configuration such that the edge 52*b* does not itself extend into the sealing material 50 although the top of the curl 50*b* does. The configuration of the curl 40*b* which requires two forming operations increases the length of the seal along the sealing material 50, thereby assuring good sealing and isolation of the raw edges.

Figure 4C:
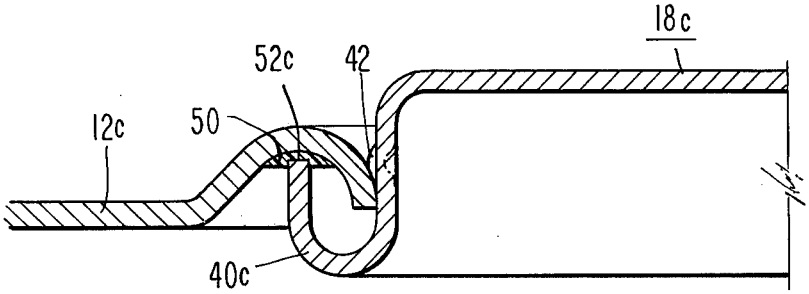

In FIG. 4*c*, the curl 40*c* of the plug 18*c* more closely resembles the flange of the vent hole plug 22 where the edge 52*c* of the curl 40*c* is entirely embedded within the sealing material 50. Note that the panel 12*c* is of a slightly different configuration to accommodate the curl 40*c* which may be made in a single forming operation.

Figure 4D:
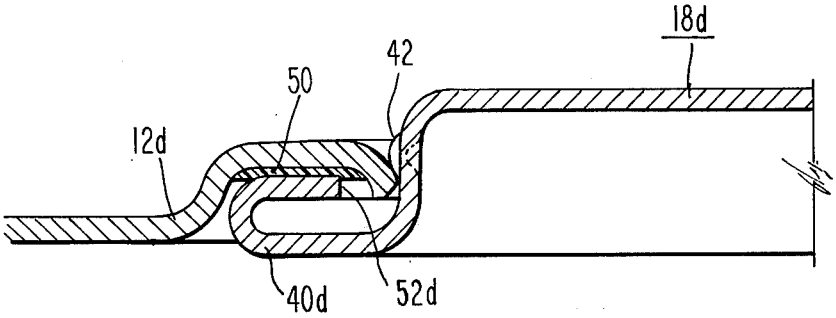

FIG. 4*d* discloses yet another curl 40*d* and another configuration of a panel 12*d*. Although the curl 40*d* of the plug 18*d* would, in general, require two forming operations, the embodiment of FIG. 4*d* is advantageous since it does provide a substantial length of seal so as to assure proper closing of the dispensing opening by the plug 18 while also precluding any risk of contamination by the raw edges of the plug 18*d* or the panel 12*d*.

Figure 4E:
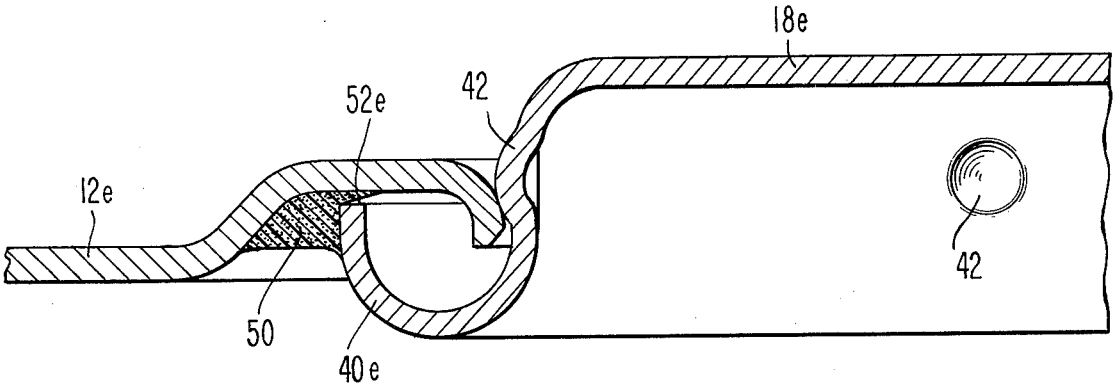
Figure 4F:
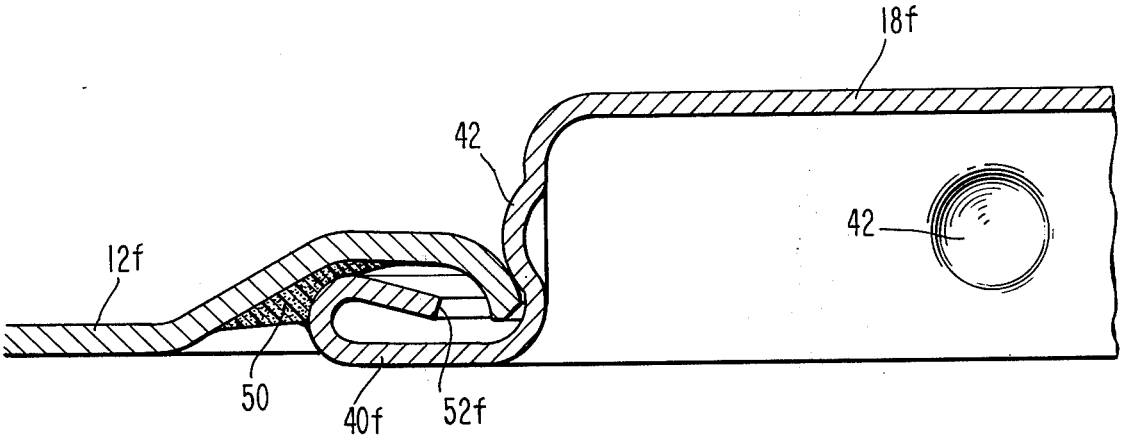

In the embodiments of FIG. 4 as well as FIGS. 4(*a-d*), the sealing material 48 and 50 is applied before the plug 18 is inserted into the dispensing opening 16. In the embodiment of FIG. 4*e*, the sealing material 50 is applied after the plug 18*e* is inserted into the dispensing opening 16. However, the sealing material 50 does extend above the edge 52*e* of the flange 40*e* so as to assure that increased pressure on the plug 18*e* from the interior of the can will increase the isolation of the edge 52*e* of the plug 18*e* as well as the edge of the end panel 12*e*. Similarly, the sealing material 50 may be applied after assembling the plug 18*f* in the dispensing opening of the end panel 12*f* as shown in FIG. 4*f* where the flange 40*f* on the plug 18*f* is hemmed so that the edge 52*f* is spaced radially inwardly from the sealing material 50. Once again, the sealing material 50 does extend above a portion of the flange 40*f* so as to assure a more effective seal as pressure on the interior of the can increases. The hemmed edge shown in FIG. 4*f* is particularly advantageous so as to improve hoppering during the assembly operation.

Figure 4G:
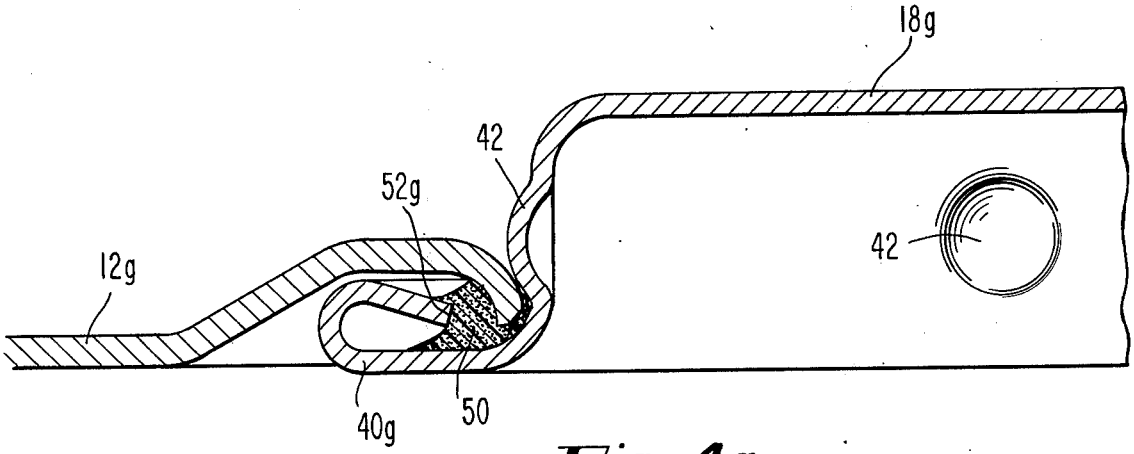

FIG. 4*g* shows yet another embodiment where the sealant material 50 is applied to the flange 4*g* prior to assembling the plug 18*g* in the opening of the end panel 12*g*. Note that the sealant material 50 covers the edge 52*g* of the plug 18*g* as well as the edge of the blank 12*g*. It also extends above the flange 40*g* to assure improved sealing under conditions of increased pressure within the can.

Although only one vent hole plug 22 and only one end panel configuration adjacent the vent hole 20 have been shown, it will be understood that the various alternatives available for use with the dispensing plug 18 as shown in FIGS. 4(*a-g*) are also available for use with the vent hole plug 22.

A somewhat different type of dispensing plug is shown in FIGS. 4(*h* and *i*) wherein the dimples have been eliminated. The plug 18*h* shown in FIG. 4*h* comprises an annular wall 14*h* which forms an angle of $\alpha$ (preferably 2°–10°) with the axis of the plug 18*h* to permit the plug 18*h* to be wedges into the closed position and still accommodate the rather large tolerance between the opening in the blank 12*h* and the diameter of the wall 42*h*. In general, the plug 18*h* with the tapering annular wall 42*h* is less costly to manufacture than, for example, the plug 18 with the dimples 42. At the same time, the annular wall 42*h* does provide a sufficient retaining function to hold the plug 18*h* within the opening of the blank 18 *h* prior to its application to a can where it is subjected to the pressure of the contents within the can.

Figure 4H:
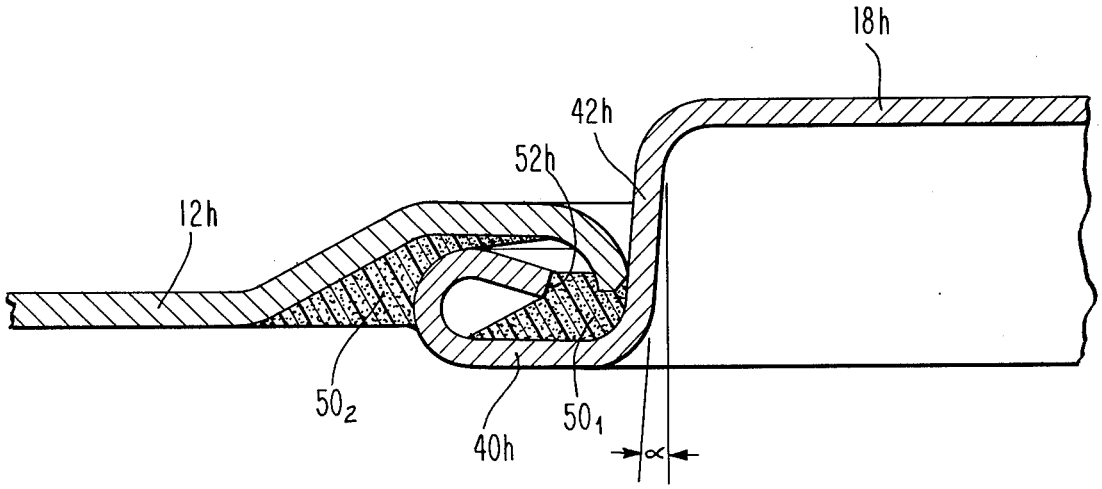

In the embodiment shown in FIG. 4*h*, sealing material $\mathbf{50_1}$ fills the annular groove formed by a flange 40*h* so as to essentially cover the raw edge 52*h* of the flange 40*h* as well as the edge of the panel 12*h* at the opening. In addition, sealant material $\mathbf{50_2}$ is utilized radially outwardly and above the flange 40*h* to form a seal.

Figure 4I:
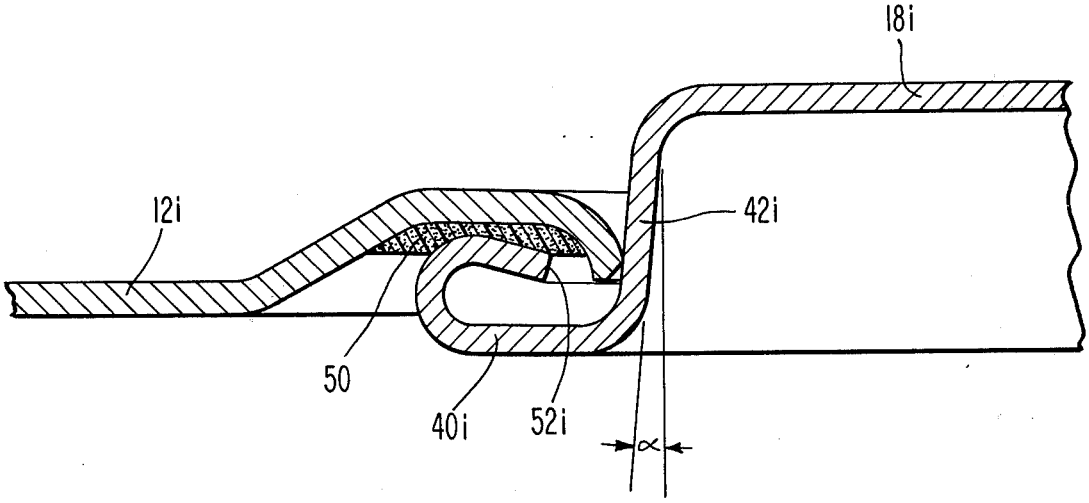

In the embodiment of FIG. 4*i*, the plug 18*i* having a tapered annular wall 42*i* at an angle $\alpha$ with the axis of the plug is substantially identical to the plug 18*h*. However, the sealant 50 extends completely across the top of the flange 40*i*. Note that the sealant material 50, which may comprise a hot melt, is applied before the plug 18*i* is inserted into the opening of the blank 12*i*. The same is true with respect to the sealing material $\mathbf{50}_1$ in the embodiment of FIG. 4*h*. However, the sealing material $\mathbf{50}_2$ is applied after the plug 18*h* is inserted into the opening of the blank 12*h*.

It will of course be appreciated that vent hole plugs may be made which are similar or identical to the dispensing opening plugs 18*h* and 18*i*. Since there are no means such as dimples to retain the vent hole plugs in place after opening, it is preferred that the vent holes and the dispensing openings have substantially identical diameters for receiving substantially identical vent hole and dispensing opening plugs. This will of course preclude a vent hole plug from being discharged through a dispensing opening when the contents of a can are being dispensed.

Figure 5:
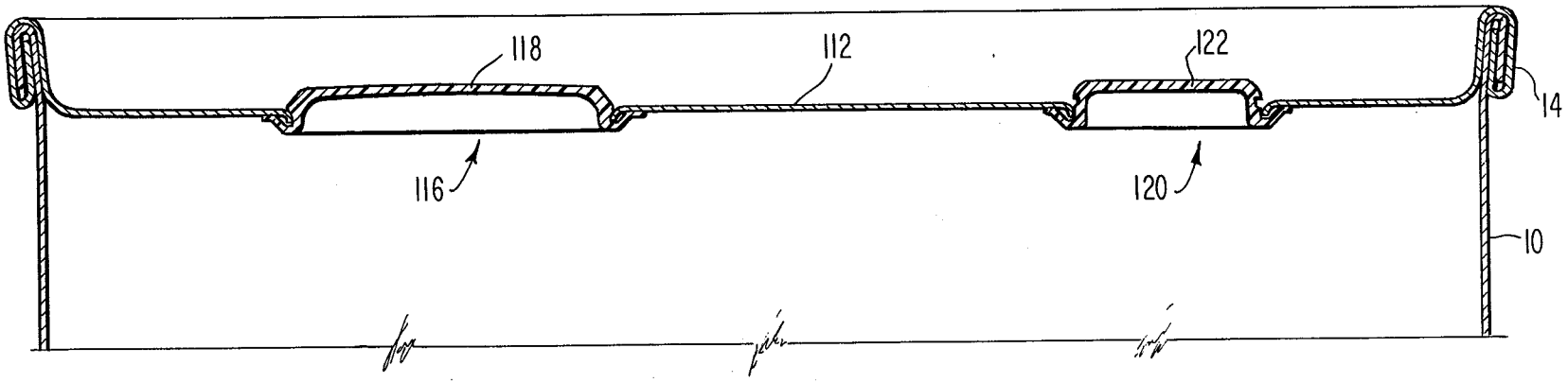
FIG. 5 is a sectional view of an easy opening can end representing another preferred embodiment of the invention.

Reference will now be made to FIG. 5 wherein an embodiment of the invention utilizing plastic plugs is shown. As shown, a plastic dispensing plug 118 is inserted into the dispensing opening 116 and a plastic vent hole plug 122 is inserted into the vent hole 120. The plastic vent hole plug 122 will now be described with reference to FIGS. 6 and 7.

Figure 6:
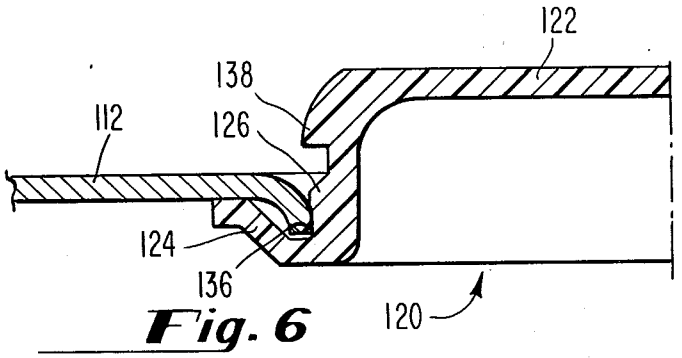
FIGS. 6 and 7 are sequential views of the venting plug shown in FIG. 5 in the closed and venting positions respectively.
Figure 7:
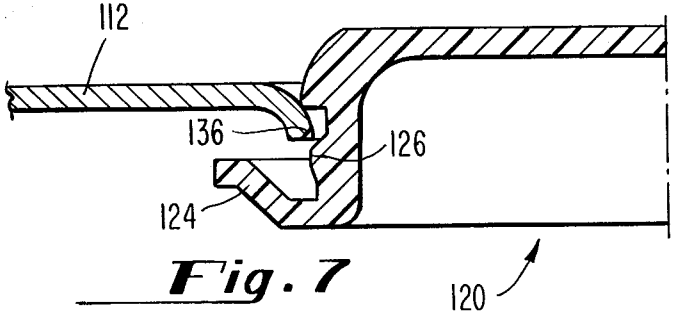

As shown in FIGS. 6 and 7, the vent hole plug 122 comprises a first radially outwardly extending portion or flange 124 and a second radially outwardly extending portion or annular bead 126 with the outwardly extending curl of panel 112 extending therebetween. The uppermost portion of the flange 124 sealingly engages the under or interior side of the panel 112 when the vent hole plug 122 is in the first or closed position as shown in FIG. 6. Sealing engagement between the uppermost portion of the flange 124 and the end panel 112 at a point radially outwardly spaced from the edge 136 at the vent hole 120 may be achieved by the nature of the simultaneous contact of the panel 112 by the flange 124 and the ridge 126 which forces the flange 124 upwardly into sealing contact with the panel 112. More importantly, internal pressure of the can on the plug 122 including the flange 124 which extends substantially radially outwardly beyond the ridge or bead 126 enhances the sealing engagement between the flange 124 and the panel 112. Since the plastic of the plug 122 is itself relatively soft as compared with the end panel 112, there is no necessity for a separate sealing compound or material or groove for receiving that compound although it might be utilized. The plug 122 also includes a radially outwardly extending retaining portion or annular bead 138 which is axially spaced from the bead 126.

As shown in FIG. 7, the edge 136 of the panel 112 will serve to retain plug 122 by extending between the beads 126 and 138 when the plug 122 is moved to the second or venting position. In order to assure that the vent hole plug 122 will not be forced through the vent hole 120, the bead 138 extends radially outwardly beyond the bead 126. Note that the edge 136 is again coined and does curl downwardly so as to preclude the cutting of any fingers during opening.

Figure 8:
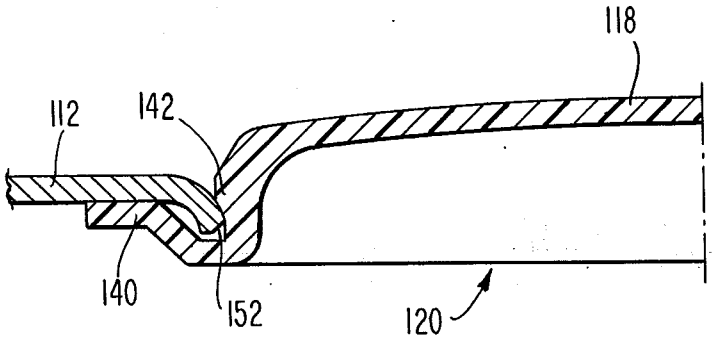
FIG. 8 is a sectional view of the dispensing opening plug of FIG. 5 in the closed position.

Referring to FIG. 8, the dispensing plug 118 in the dispensing hole 116 is similar to the vent hole plug 122 except for the absence of the retaining portion. More particularly, the plug 118 includes a first portion or flange 140 which extends radially outwardly and a second portion or annular bead 142 which also extends radially outwardly with the outwardly extending curl portion of the panel 112 near the coined edge 152 extending between the flange 140 and the bead 142. Again, the flange 140 and the bead 142 are in simultaneous engagement with the panel 112 and the internal pressure of the can forces the flange 140 into sealing engagement with the under side of the panel 112 thereby assuring that the dispensing opening 118 seals the dispensing opening 112 closed while also precluding contamination of the contents of the can by the raw edge 152 of the panel 112.

In all of the embodiments illustrated in the drawings, the vent hole plug is smaller than the dispensing opening plug. Under these circumstances, additional radially outwardly extending projections or dimples have been provided to prevent the smaller vent hole plug from being pushed into the can. It is however possible to incorporate many aspects of the invention into a can end wherein the dispensing opening plug as well as the vent hole plug are of exactly the same size and the additional projections or dimples may be eliminated.

Many different materials may be utilized for the relatively soft sealing compound in the embodiment of FIGS. 1--4 and 4(*a-i*). Of course, it must serve its sealing function without being toxic. It has been found that various plastics, rubber sealants and hot melting sealing compounds can be utilized. One particularly well suited material is plastisol. The plastic dispensing plug 118 and the plastic venting plug 122 may also comprise a number of suitable materials including acrylics, nylon fluoro plastics, phenolics, polyethylene and polystyrene.

In accordance with this invention, an easy-opening can end design has been provided which permits the use of a steel end panel so as to achieve the advantages inherent in such a material. It will, of course, be appreciated that other metals might be utilized including aluminum and aluminum alloys.

Although specific embodiments of the invention have been shown and described and various modifications suggested, it will be understood that other embodiments and modifications fall within the true spirit and scope of the invention as set forth in the appended claims.

What is claimed is:

1. A can of the easy-opening type comprising:

a can body;

an end panel attached to said body having a dispensing opening and a vent hole spaced from said dispensing opening, said vent hole being smaller than said dispensing opening;

a dispensing opening plug extending into said dispensing opening and sealingly engaging said end panel so as to close said dispensing opening, said dispensing opening plug being adapted to be pushed through said dispensing opening into said can body; and a vent hole plug extending into said vent hole and sealingly engaging said end panel so as to close said vent hole, said vent hole plug being adapted to be pushed into said can body to a position of venting engagement with said end panel, said vent hole plug including first means adapted to form a seal between said panel and said vent hole plug when said vent hole plug is in said first position and second means for retaining said vent hole plug within said vent hole when said vent hole plug is in venting engagement with said end panel so as to prevent the passage of said vent hole plug through said dispensing opening.

2. The can of claim 1 wherein said first means of said vent hole plug comprises a radially outwardly extending interior portion and a radially outwardly extending exterior portion with the edge of said panel at said vent hole extending therebetween when said vent hole plug sealingly engages said end panel, said second means comprising a radially outwardly extending retaining portion axially spaced from said radially outwardly extending exterior portion, said edge of said end panel adapted to extend between said retaining portion and said exterior portion so as to retain said vent hole plug within said vent hole when in said venting position.

3. The can of claim 2 wherein said retaining portion extends radially outwardly beyond said exterior portion.

4. The can of claim 2 wherein said interior portion sealingly engages said end panel and the interior thereof at a point radially outwardly spaced from said edge of said panel so as to preclude exposure of the contents of the can to the edge of said end panel at said vent hole.

5. The can of claim 4 wherein said vent hole plug comprises sheet metal and said can comprises a relatively soft sealing material located adjacent said vent hole, said interior portion of said vent hole plug having a sheet metal edge, said vent hole plug sealingly engaging said sealing material adjacent said edge of said sheet metal so as to preclude exposure of the contents of said can to the edge of said sheet metal and the edge of said end panel at said vent hole.

6. The can of claim 5 wherein said end panel includes a groove around said vent hole on the interior of said can, said soft sealing material being located within said groove.

7. The can of claim 5 wherein said retaining portion and said exterior portion comprise a plurality of radially outwardly extending dimples.

8. The can of claim 4 wherein said vent hole plug comprises a plastic material forming a seal between said end panel and said vent hole plug, said edge of said end panel adjacent said vent hole extending between said interior portion and said exterior portion, said interior portion sealingly engaging said end panel radially outwardly from said edge of said end panel adjacent said vent hole.

9. The can of claim 1 wherein said dispensing opening plug comprises a radially outwardly extending interior portion and a radially outwardly extending exterior portion spaced from said radially outwardly extending interior portion, the edge of said end panel at said dispensing opening extending between said interior portion and said exterior portion while said end panel simultaneously engages said interior portion and said exterior portion.

10. The can of claim 9 wherein said interior portion sealingly engages said end panel on the interior thereof a spaced distance from the edge of said end panel at said dispensing opening so as to preclude exposure of the contents of the can to the edge of said end panel at said dispensing opening.

11. The can of claim 10 wherein said dispensing opening plug comprises sheet metal and said can further comprises a relatively soft sealing material adjacent said dispensing opening, said interior portion of said dispensing opening plug being formed in part by the edge of said sheet metal, said dispensing opening sealingly engaging said sealing material adjacent said edge of said sheet metal so as to preclude exposure of the contents of said can to the edge of said sheet metal and the edge of said end panel at said dispensing opening.

12. The can of claim 11 wherein said end panel includes a groove around said dispensing opening on the interior of said can, said soft sealing material being located within said groove.

13. The can of claim 10 wherein said dispensing opening plug comprises a plastic material forming a seal between said end panel and said dispensing opening plug, said edges of said end panel adjacent said dispensing opening extending between said interior portion and said exterior portion, said interior portion sealingly engaging said end panel radially outwardly from said edge of said end panel adjacent said dispensing opening.

14. A can end of the easy-opening type comprising:

an end panel having an opening extending from the upper side to the under side thereof;

a push-in plug extending into said opening and sealingly engaging said end panel so as to close said opening, said plug including a first portion extending radially outwardly from said opening on the under side of said panel and a second portion extending radially outwardly from said opening on the upper side of said panel, said panel extending radially inwardly beyond the radial outermost extremities of said first portion and said second portion, said second portion cooperating with said panel so as to retain said plug in said opening before application to a can while also providing predictably uniform opening resistance when said plug is pushed in.

15. The can end of claim 14 wherein the area of sealing engagement between said panel and said plug is located above said first portion of said plug and radially outwardly from said edge of said panel at said opening.

16. The can end of claim 14 wherein said end panel includes a downwardly curling portion adjacent said edge of said panel at said opening, said second portion of said plug engaging said panel adjacent said edge of said panel at said opening and above said downwardly curling portion.

17. The can end of claim 15 wherein said plug comprises sheet metal and said can further comprises a relatively soft sealing material in said area of sealing engagement.

18. The can end of claim 17 wherein said panel is raised around said opening so as to form a groove receiving said sealing material.

19. The can end of claim 17 wherein said first portion is curled upwardly so as to form a groove receiving said sealing material.

20. The can end of claim 16 wherein said second portion comprises a plurality of radially outwardly extending protuberances.

21. The can end of claim 15 wherein said plug comprises a plastic material forming a seal with said end panel in said area of sealing engagement.

22. A can of the easy-opening type comprising:

a can body;

an end panel attached to said body and having a dispensing opening extending from the upper side to the under side thereof, said end panel including a downwardly extending portion leading to an edge of said panel at said opening;

a push-in closure extending into said opening and sealingly engaging said end panel so as to close said opening, said closure including a first portion extending radially outwardly from the edge of said panel at said opening and spaced radially outwardly from said downwardly extending portion;

the area of sealing engagement between said panel and said closure being located above said first portion of said plug and spaced radially outwardly from the edge of said panel at said opening and said downwardly extending portion of said end panel such that the strength of the seal is increased in response to a pressure differential between the upper side and the under side of the closure so as to enhance the isolation of said edge of said opening from the contents of the can.

23. The can of claim 22 wherein said plug comprises sheet metal and said can further comprises a relatively soft sealing material in said area of sealing engagement.

24. The can of claim 23 wherein said end panel is raised around said opening so as to form a groove receiving said sealing material.

25. The can of claim 23 wherein said first portion is curled upwardly so as to form a groove receiving said sealing material.

26. The can of claim 22 wherein said plug comprises a plastic material forming a seal with said end panel in said area of sealing engagement.

27. The can of claim 22 wherein said plug further comprises a second portion extending radially outwardly from and above the edge of said panel at said opening to assist in retaining said plug in said opening.

28. The can of claim 22 wherein said plug comprises a second portion including an annular, tapered wall which engages the end panel radially inwardly from the edge of said panel at said opening.

29. A can of the easy-opening type comprising:

a can body;

an end panel attached to said body and having a dispensing opening extending from the upper side to the under side thereof;

a sealing material in sealing contact with said end panel radially outwardly of said opening;

a sheet metal push-in plug extending into said opening and sealingly engaging said end panel so as to close said opening, said plug including a first portion extending radially outwardly from the edge of said panel at said opening and leading to a raw edge of said sheet metal plug;

the area of sealing engagement between said panel and said plug being located above and along a surface of said first portion of said plug leading to said raw edge and radially outwardly from the edge of said panel at said opening and said raw edge of said plug such that the strength of the seal is increased in response to a pressure differential between the upper side and the under side of the plug so as to enhance the isolation of said edge of said opening and said raw edge of said plug from the contents of the can.

30. The can of claim 29 wherein said end panel is raised around said opening so as to form a groove receiving said sealing material.

31. The can of claim 30 wherein said first portion is curled upwardly so as to form a groove receiving said sealing material.

32. The can of claim 29 wherein said plug further comprises a second portion extending radially outwardly from and above the edge of said panel at said opening to assist in retaining said plug in said opening.

33. The can of claim 29 wherein said plug comprises a second portion including an annular, tapered wall which engages the end panel radially inwardly from the edge of said panel at said opening.

34. A can of the easy-opening type comprising:

a can body;

an end panel attached to said body and having a dispensing opening extending from the upper side to the under side thereof;

a push-in plug extending into said opening and sealingly engaging said panel so as to close said opening, said plug comprising a plastic material and including a first portion extending radially outwardly from the edge of said panel at said opening;

the area of sealing enagagement between said panel and said plug being located above said first portion of said plug and radially outwardly from the edge of said panel at said opening such that the strength of the seal is increased in response to a pressure differential between the upper side and the under side of the plug so as to enhance the isolation of said edge of said opening from the contents of the can.

35. A can end of the easy-opening type comprising:

an end panel adapted to be attached to a can body, said end panel having a dispensing opening surrounded by an edge, a raised portion surrounding said edge, and an outwardly extending portion below said edge and said raised portion;

a push-in closure including a plug portion extending into said opening and a flange portion extending outwardly from said edge, at least a portion of said flange portion extending above said outwardly extending portion; and sealing means between said end panel and said flange portion.

36. The can end of claim 35 wherein said sealing means extends outwardly from said flange portion to said end panel.

37. The can end of claim 35 wherein said push-in closure comprises plastic.

38. The can end of claim 35 wherein said push-in closure comprises sheet metal.

39. A can ed of the easy-opening type comprising:

an end panel adapted to be attached to a can body and having a dispensing opening and a vent hole spaced from said dispensing opening, said vent hole being smaller than said dispensing opening;

dispensing opening plug means extending into said dispensing opening and sealingly engaging said end panel so as to close said dispensing opening, said dispensing opening plug means being adapted to be pushed through said dispensing opening into said can body; and vent hole plug means extending into said vent hole and sealingly engaging said end panel so as to close said vent hole, said vent hole plug means being adapted to be pushed into said can body to a position of venting engagement with said end panel, said vent hole plug means including means for retaining said vent hold plug means within said vent hole when said vent hole plug means is in venting engagement with said end panel so as to prevent the passage of said vent hole plug means through said dispensing opening.

40. The can end of claim 39 further comprising sealing means located radially outwardly from said dispensing opening and said vent hole.

41. The can end of claim 40 wherein said dispensing opening and said vent hole have edges further comprising sealing means spaced radially outwardly from said edges so as to preclude exposure of the contents of the can to the edge of said end panel.

42. The can end of claim 39 wherein said dispensing opening plug means and said vent hole plug means comprise a plastic material.

43. The can end of claim 39 wherein said dispensing opening plug means and said vent hole plug means comprise sheet metal.

44. The can end of claim 39 wherein said end panel is raised around said dispensing opening and said vent hole.

45. A can end of the easy-opening type comprising:

an end panel adapted to be attached to a can body, said end panel including a dispensing opening, a raised portion surrounding said dispensing opening, and an outer portion located outwardly from and below said raised portion;

a push-in closure including a plug portion extending into said opening and a flange portion extending outwardly from said plug portion, said flange portion being substantially recessed upwardly within said raised portion; and sealing means extending outwardly from said flange portion to said end panel.

* * * * *

UNITED STATES PATENT AND TRADEMARK OFFICE

CERTIFICATE OF CORRECTION

PATENT NO. : 4,024,980

DATED : May 24, 1977

INVENTOR(S) : Raymond H. P. Kneusel and Vinson S. Potts

It is certified that error appears in the above-identified patent and that said Letters Patent are hereby corrected as shown below:

Column 1, line 52, after "pull-out" insert --plug--.

Column 2, line 58, the word "pushin" should read --push-in--.

Column 2, line 61, the word "pushin" should read --push-in--.

Column 3, line 32, after "sequential" insert--sectional--.

Column 3, line 67, the word "hold" should read --hole--.

Column 4, line 27, after the word "side" insert --and the under side--.

Column 6, line 57, the number "18" should read --12--.

Column 12, first line of claim 39, the word "ed" should read --end--.

Signed and Sealed this

*Twenty-seventh* Day of *September 197*

[SEAL]

*Attest:*

RUTH C. MASON
*Attesting Officer*

LUTRELLE F. PARKER
*Acting Commissioner of Patents and Trademark*